United States Patent [19]

Dechelette

[11] Patent Number: 4,737,122

[45] Date of Patent: Apr. 12, 1988

[54] MULTICONDUCTOR CONNECTOR

[75] Inventor: Helen Dechelette, Paris, France

[73] Assignee: Molex Incorporated, Lisle, Ill.

[21] Appl. No.: 27,461

[22] Filed: Mar. 18, 1987

[30] Foreign Application Priority Data

Mar. 18, 1986 [GB] United Kingdom ..... 8606654

[51] Int. Cl.[4] ..... H01R 4/24

[52] U.S. Cl. ..... 439/418

[58] Field of Search ..... 439/391, 417, 418

[56] References Cited

U.S. PATENT DOCUMENTS

| | | | |
|---|---|---|---|
| 3,397,380 | 8/1968 | Puig | 439/417 |
| 3,761,869 | 9/1973 | Hardesty et al. | 439/418 |
| 3,954,320 | 5/1976 | Hardesty | 439/418 |

*Primary Examiner*—Joseph H. McGlynn

*Attorney, Agent, or Firm*—John W. Cornell; Louis A. Hecht

[57] ABSTRACT

An insulation displacement type connector for terminating a plurality of insulated conductors. The connector has a housing defined by a generally cylindrical open ended configuration. Insulation displacement type terminals are mounted on the housing around the periphery thereof. The terminals are radially directed such that they are moveable into the interior of the housing. A conductor carrier is telescopically received in the interior of the housing. The carrier has a conductor-receiving surface which aligns the conductors adjacent the terminals when received in the housing. Also disclosed is a method of assembling the connector.

9 Claims, 4 Drawing Sheets

MULTICONDUCTOR CONNECTOR

BACKGROUND OF THE INVENTION

1. Field Of The Invention

The present invention pertains to connectors for terminating a plurality of insulated conductors, and in particular to plug connectors having several interfitting members.

2. Brief Description of the Prior Art

Modular telephone connectors are well known in the art for providing a high density package for multiple circuits. Typically, modular telephone plugs include an insulating housing having one or more wire-receiving channels and a plurality of piercing-type electrical terminals moveable in the housing so as to communicate with the wire receiving channels. One example of such a connector is show in U.S. Pat. No. 3,761,869 which shows a two-piece plug housing comprised of interfitting housing members having mating faces which form the wire receiving channels. That is, each housing member has formed therein wire-receiving grooves each for receiving one half of a side-by-side array of electrical cable conductors. One of the housing members has formed therein terminal-receiving cavities which extend to the wire-receiving channels. Terminals received in the cavities are typically of a stamped and formed flat plate construction having an outer edge or slideable mating contact with a receptacle connector, and having an inner edge with insulation piercing points which are advanced toward cable conductors received in the housing.

While strain relief is provided when the two housing members are compressed together, that strain relief is remote from the terminals. Automated assembly rates can be increased if wire management, especially for wire portions immediately adjacent the terminals is improved. While developed for use in the telephone industry, four conductor and even six conductor cables are the largest sizes typically encountered. With the increasing popularity of digital technology, input output connector systems could take advantage of many of the modular plug features if connector systems for a significantly greater number of circuits can be provided in a small size high density package. Also, to be economically attractive, any simplification of the housing molding result in cost savings in molding maintenance, more reliable tolerance control and fewer rejects in harness assembly.

Another example of a modular telephone connector is shown in U.S. Pat. No. 4,373,766 which offers some improvement in wire handling. In this arrangement, cable conductors are wrapped around a wire carrier, which is then telescopically inserted in a connector housing. While generally improving mass automation, wire management at the point of termination is not controlled, and takes place in a blind assembly process. Again, strain relief is not provided for the individual circuit conductors of the cable. Also, the terminals of the arrangement are wire-formed members, rather than the piercing type terminals described above, which are easier and more reliable to manufacture. Any simplification of the housing which allows greater cost savings in the molding operation is also desired.

In each of the above arrangements, and in modular connectors in general, improved methods of harness assembly are constantly being sought.

SUMMARY OF THE INVENTION

Accordingly, it is an object of the present invention to provide improved methods of harness assembly for multicircuit cables and high density plug connectors having flat blade, insulation piercing types of terminals.

Another object of the present invention is to provide improved wire management, especially, for those wire portions which are pierced by flat blade terminals in a mass termination operation.

Another object of the present invention is to provide a small size high density modular plug connector for multicircuit cables.

These and other objects of the present invention are provided in a connector for terminating a plurality of insulated conductors, comprising a housing having a front mating end with an opening therein and a rear cable receiving end with an opening therein, and an internal passageway extending between the openings, a plurality of terminals mounted in the housing around the periphery thereof, each having an internally extending conductor engaging portion and an external mating contact portion, the terminals moveable between a first carrier-receiving position and a second terminated position wherein the conductor engaging portions extend into the passageway, a conductor carrier telescopically received in the passageway, the carrier having an external conductor-receiving surface adjacent the terminals, tapered toward the rear end, and having means for receiving and aligning the conductors with the conductor engaging portions of respective terminals, and the passageway having a configuration complementary to the carrier with the front opening being larger than the rear opening, whereby the carrier is receivable into the passageway through the front opening of the housing after the wires have been received on the surface thereof, and the conductors are terminated to the terminals when the terminals are moved to their terminated positions.

The objects of the present invention are also provided in an improved method of assembling a connector for terminating a plurality of insulated conductors. The connector including a housing having a front mating end with an opening therein and a rear cable receiving end with an opening therein, and an internal passageway extending between the openings, a plurality of terminals mounted in the housing around the periphery thereof, each having an internally extending conductor engaging portion and an external mating contact portion, the terminals moveable between a first carrier-receiving position and a second terminated position wherein the conductor engaging portions extend into the passageway, and a conductor carrier telescopically received in the passageway, the carrier having an external conductor-receiving surface adjacent the terminals and tapered toward the rear end, with means for receiving and aligning the conductors with the conductor engaging portions of respective terminals, and the passageway having a configuration complementary to the carrier with the front opening being larger than the rear opening, comprising the steps of inserting free ends of the conductor cable through the second housing end so that the conductor free ends extend beyond the first mating housing end, engaging the conductors with the external carrier surface, inserting the carrier and the conductors into the housing mating ends while maintaining engagement between the carrier and the conductors, and moving the terminals toward the carrier to their second terminated positions, to terminate respective wires.

BRIEF DESCRIPTION OF THE DRAWINGS

In the drawings, wherein like elements are referenced alike, three different embodiments of the present invention are shown: a cylindrical embodiment is shown in FIGS. 1–4, a rectangular embodiment is shown in FIGS. 5–8, and a hybrid arrangement is shown in FIG. 9. More specifically.

DETAILED DESCRIPTION OF THE PREFERRED EMBODIMENT

Figure 1:
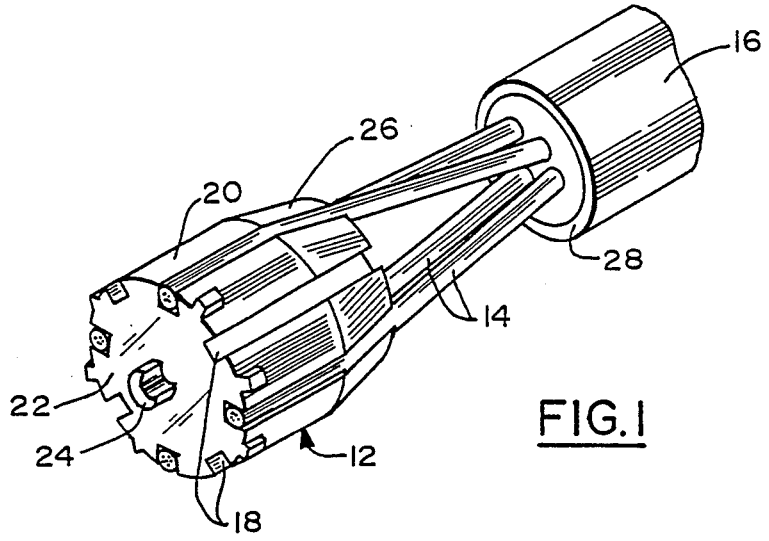
FIG. 1 is a perspective view of the cylindrical wire carrier of the present invention to which the circuit conductors of a round cable are applied in preparation for termination in a mating cylindrical housing.

With reference now to the drawings, and in particular to FIGS. 1–4, a first embodiment of the connector of the present invention is generally indicated at 10. FIG. 1 shows a wire carrier 12 of the present invention to which the insulated circuit conductors 14 of a conventional multicircuit round cable 16 have been applied. According to the preferred method of assembling connector 10, the cable 16 and the circuit conductors 14 are first inserted through generally hollow cylindrical housing 30 before circuit conductors are applied to carrier 12, is indicated in FIGS. 3*a*, 3*b*.

FIG. 1 is provided to more clearly show the wire carrier of the present invention in a three dimensional perspective. As such, FIG. 1 clearly shows that carrier 12 is of a generally cylindrical configuration, having a plurality of axially extending wire-receiving grooves 18 at its outer periphery or surface 20. Carrier 12 has a forward mating wall 22 from which an outwardly extending keying member 24 protrudes, along the axis of carrier 12. At the opposite end of carrier 12, the outer surface 20 is tapered in a direction away from mating face 22. The numeral 26 is applied to the tapered portion of outer surface 20.

As indicated in FIG. 1, cable 16 has an outer dielectric sheath 28 which is removed to expose the insulated circuit conductors 14. The length of the exposed conductors 14, extending between the tapered end of carrier 12 and the free end of sheath 28 is shown to an exaggerated extent, for illustrative purposes. Those skilled in the art will appreciate that in practice the tapered end of carrier 12 can be brought very close to the free end of sheath 28.

Figure 2:
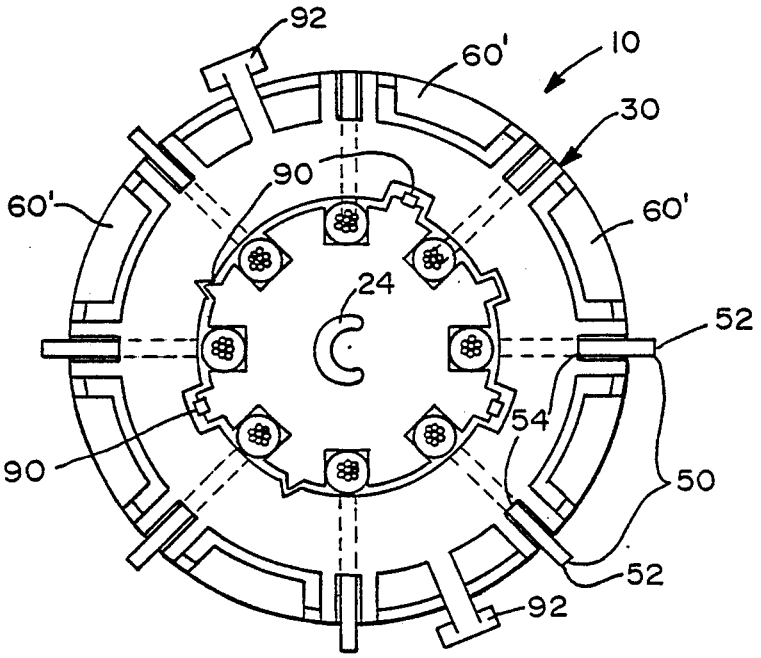
FIG. 2 is an end view of the insert of FIG. 1, shown fully installed in a cylindrical, generally hollow plug housing.
Figure 3A:
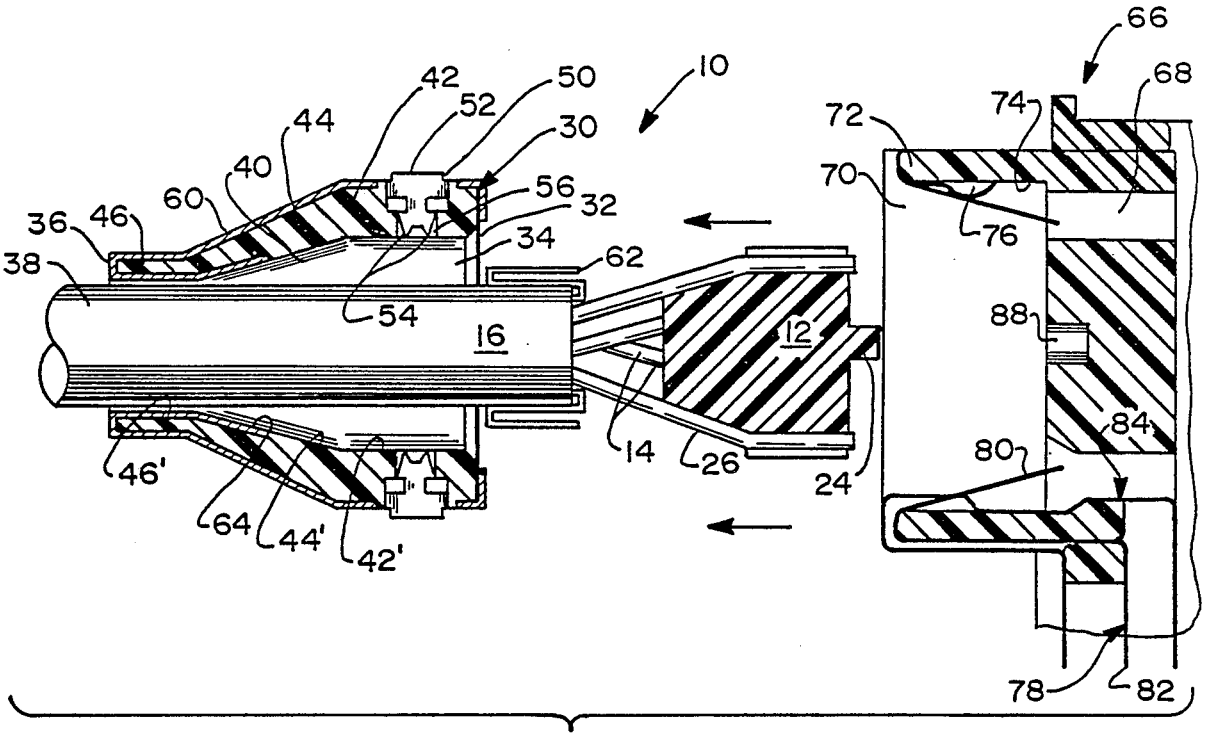
FIG. 3*a* is an exploded cross-sectional elevational view of the harness assembly of FIG. 2 showing the assembly technique, prior to termination.

Turning now to FIGS. 2 and 3, and initially to FIG. 3*a*, cable 16 is inserted through the generally hollow, cylindrical housing 30. As can be seen in FIG. 3*a*, housing 30 has a front mating end 32 with an opening 34 therein and a rear cable receiving end 36 having an opening 38 therein. An internal passageway 40 extends between openings 34, 38. The free end of cable 16 is inserted through opening 38, along passageway 40, and emerges a substantial distance beyond mating face 32, so as to provide easy access for dressing the conductors 14 over carrier 12, as depicted in FIG. 1.

Referring again to FIG. 3*a*, housing 30 can be seen to comprise a forward cylindrical portion 42 of enlarged diameter, a rearwardly tapered transition portion 44, and a rear cylindrical portion 46 of reduced diameter. Passageway 40 is defined by the radially interior surfaces 42', 44', and 46' of wall portions 42–46, respectively. Insert 12 has as complementary configuration of external surfaces 20, 26 which provide intimate mating with interior surfaces 42', 44' when the subassembly of FIG. 1 is drawn in a rearward (leftward in FIG. 3*a*) direction through housing 30. When drawn rearwardly through housing 30, tapered carrier surface 26 compresses conductors 14 against tapered inner housing surface 44' to provide an improved strain relief for the insulated conductors. If conductors 14 are of extremely small gauge or are otherwise delicate, the depth of channels 18 formed in carrier 12 can be carefully controlled to provide the proper amount of compression of the conductors 14, between surfaces 26, 44'. Alternatively, carrier 12 can be dimensioned and configured in shape to provide further simultaneous engagement between carrier cylindrical surface 20 and internal surface 42'.

Referring now to FIGS. 2 and 3*a*, a plurality of generally flat plate-like terminals 50 are mounted in passageways 56 of housing 30, and have an external mating contact portion 52 and an internally extending conductor engaging portion 54. Preferably, conductor engaging portion 54 is comprised of insulation piercing points as shown in the figure. However, other known terminating portions can be employed in the connector arrangement of the present invention. One variation, for example, includes insulation displacing edges of opposed tip members, which straddle the electrically conductive portions as the conductive insulation is displaced from its outer sides.

Figure 3B:
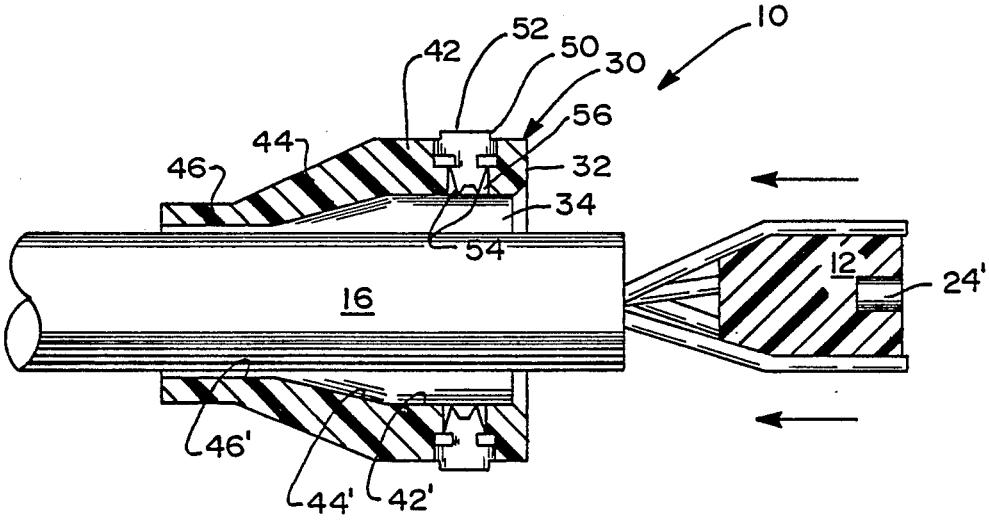
In FIG. 3*b*, an unshielded variation of the arrangement of FIG. 3*a* is shown.
Figure 4:
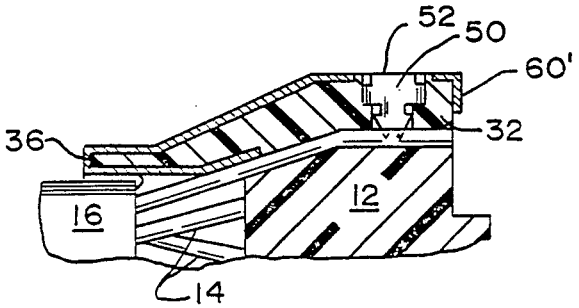
FIG. 4 is a partial cross-sectional elevational view of a fully assembled and terminated connector of FIGS. 1–3.

As can be seen and by comparing FIG. 3*a* to FIG. 4, terminals 50 are moveable between a first carrier-receiving position (FIG. 3*a*) and a second terminated position (FIG. 4) wherein the conductor engaging portions 54 extend into passageway 40 so as to enter channels 18 to pierce the conductor received therein. In the preferred embodiment, all of the terminals 50 are simultaneously terminated to their respective conductors 14 in a single mass termination operation. However, terminals can be sequentially terminated to an individual conductor, either one at a time, or in diametrically opposed pairs and other alternatives are also possible.

The arrangements of FIGS. 3*a* and 3*b* are substantially identical. The difference between them is that a shielded cable is shown in FIG. 3*a* and an unshielded cable is shown in FIG. 3*b*. The connector of FIG. 3*a* includes a metallic shield member 60 which overlies the outer surface of housing 30, is wrapped around the rear end 36 and extends forwardly into passageway 40, overlying surfaces 46', 44'. The shield 62 of the cable is folded over the outside of the cable sheath so as to contact the tapered free ends 64 of connector shield 60 as the cable and carrier are seated in housing 30. Cable shield 60 can have a finger-like projection extending adjacent or into a terminal-receiving cavity 56 of housing 30. This finger-like projection would then emulate the contact surface 52 of a terminal 50, and can be mated to a receptacle terminal in a similar fashion.

In the preferred embodiment of FIG. 2, plug shield 60 is extended over the front circular housing portion 42, and is bent over front end wall 32, between terminals 50. The bent over portions 60' formed adjacent end wall 32 and also extending on portion 42 function as additional plug contacts with regard to their ability to mate with receptacle terminals 84 of receptacle connector 66. Although not visible in the drawings it is understood that the forward portion of shield 60 is slotted to avoid electrical contact with the mating surfaces 52 of terminals 50.

Turning now to the right hand portion of FIG. 3*a*, a mating receptacle connector of cylindrical configuration is shown comprising a dielectric housing 68 having a central cylindrical plug-receiving socket-like recess 70 extending from a mating face 72. Recess 70 is defined by an inner circular wall 74 having a plurality of inwardly extending protrusions 76 angularly aligned with the terminal positions of plug 30. A plurality of wire-formed receptacle terminals 78 are disposed about circular wall 74. Terminals 78 have a first mating end 80 extending within recess 70, and a second tail portion 82 for connection to an external circuit (not shown) such as a printed circuit board or the like. Also disposed about circular wall 74 is one or more grounding contacts 84 adapted to mate with grounding contacts positioned between terminals 50. One example of a grounding terminal mating with terminal 84 is shown in FIG. 2 wherein shield 60 extends to the mating end of connector 10, between terminals 50.

Located along the axis of cylindrical recess 70 is a polarizing recess 88 complementary configured to receive keying member 24 of the plug connector. As indicated in the end view of FIG. 2, carrier 12 and inner housing surface 42' have complementary keying projections and recesses fixing the angular orientation of individual conductors 14 with their corresponding terminals 50. The keying means 24, 88 between the plug and receptacle connectors provide rotational alignment therebetween thereby orienting the active conductive members of the connector assembly.

Also included in the end view of FIG. 2 are resilient locking arms 92 integrally molded with plug housing 30. Arms 92 provide locking interengagement with cooperating recesses (not shown) formed adjacent the masting face and circular wall 72, 74 of receptacle housing 68.

In a preferred embodiment a plug shield is extended over the front circular housing portion 42, and is bent over front end wall 32, between terminals 50, as indicated in the end view of FIG. 2. The bent over portions 60' formed adjacent end wall 32 and also extending on portion 42 function as additional plug contacts with regard to their ability to mate with receptacle terminals 84 of receptacle connector 66. Although neither indicated in the drawings it is understood that the forward portion of shield 60 is slotted to avoid electrical contact with the mating surfaces 52 of terminals 50.

Referring now to FIGS. 5–8, an alternative embodiment of the present invention is shown having a generally rectangular or flat configuration. The receptacle connector of this alternative embodiment is indicated generally at 110 and includes a rectangular wire carrier 112 to which a plurality of insulated circuit conductors 114 of conventional flat cable 116 are applied. As will be seen in the following description, wire carrier 112 bears many similarities to the previously described, generally cylindrical wire carrier 12. The principal difference is that wire carrier 112 of the alternative embodiment is configured to mate with a rectangular-shaped socket of a receptacle connector, and is readily adaptable for termination to a flat cable 116.

Figure 5:
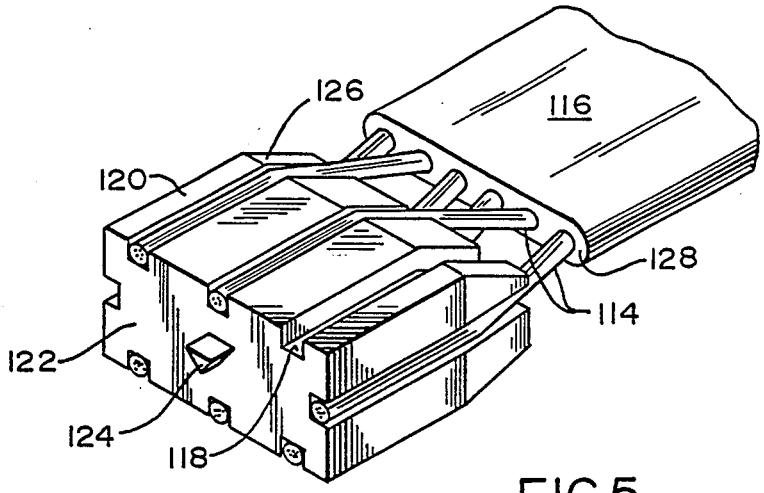
FIG. 5 is a perspective view of a rectangular wire carrier of the present invention to which the circuit conductors of a multiconductor flat cable have been applied.
Figure 6:
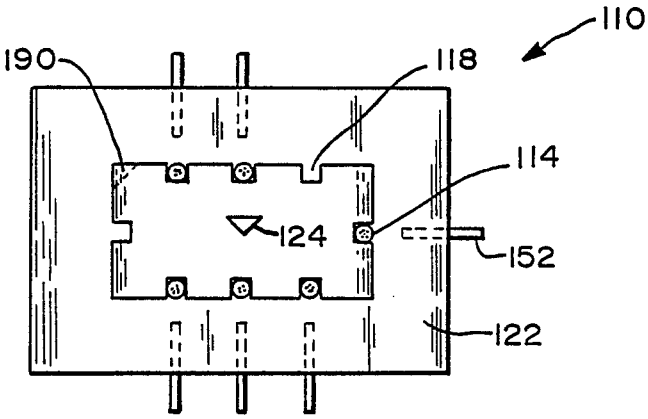
FIG. 6 is an end elevational view of an assembled harness utilizing the insert of FIG. 5, shown immediately prior to termination.

As such, carrier 112 has a first rectangular flint-like or "box-like" forward portion 120 having a mating face 122. A keying projection 124 is bent outwardly from mating face 122, to provide a keying or polarizing arrangement with a mating receptacle connector. Carrier 112 further includes a rearwardly tapered surface 126 which provides a convenient transition between the configuration or conductors 114 within cable 116, and the forward carrier portion 120. A plurality of axially-extending slots or grooves 118 is formed in the outer surfaces of carrier portions 120, 126, for receiving individual insulated conductors 114. As shown in FIG. 5, channels 118 can also be located in the sidewalls, as well as the top and bottom walls of carrier 112. Alternatively, keying recesses or projections can be provided on those sidewalls as well as the top and bottom walls of the carrier.

Figure 7:
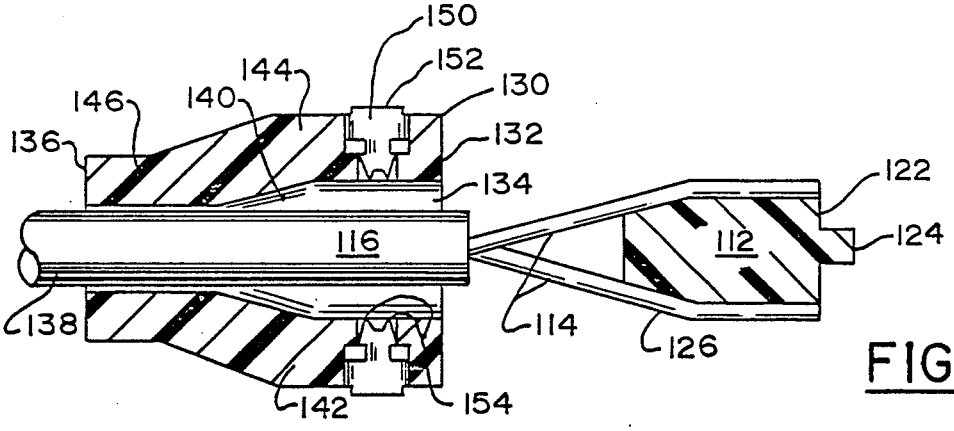
FIG. 7 is an exploded cross-sectional elevational view of the connector arrangement of FIGS. 5 and 6.
Figure 8:
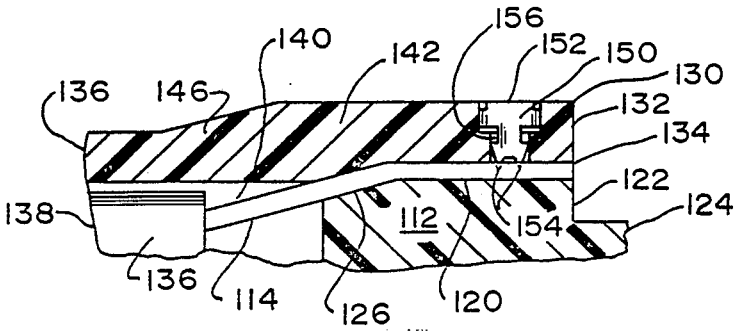
FIG. 8 is a partial cross-sectional elevational view of a fully assembed and terminated connector of FIGS. 5–7.

As indicated in FIGS. 7 and 8, cable 116 is inserted through the generally hollow housing 130 having a generally rectangular cross-sectional shape. Housing 130 has a front mating end 132 with an opening 134 therein, and a rear cable-receiving end 136 having an opening 138. An internal passageway 140 extends between openings 134, 138. The free end of cable 116 is inserted through opening 138, along passageway 140, and emerges a substantial distance beyond mating face 132, to provide easy access for addressing the conductors 114 over carrier 112 as shown in FIGS. 5 and 7.

Housing 130 includes a forward enlarged portion 142, a rearwardly tapered transition portion 144 and may include an optional rectangular portion 146 of reduced size, compared to portion 142. Passageway 140 is defined by the interior surfaces of portions 142, 144. These interior surfaces have a complementary configuration with respect to the surfaces 120, 126 of carrier 112, to provide engagement therewith. When drawn rearwardly through housing 130, carrier surface 126 compresses conductors 114 against inner surface of housing portion 144 to provide an improved strain relief for the insulated conductors.

A plurality of generally flat plate-like terminals 150 are mounted in passageways 156 of housing 130, and have an external mating contact portion 152 and an internally extending conductor engaging portion 154. Preferably, the conductor engaging portion 54 is comprised of insulation piercing points as shown in the figure. However, as explained above with reference to FIGS. 1–4, other popular terminating portions can be provided for terminals 150.

Comparing FIGS. 7 and 8, terminals 150 are moveable between a first carrier-receiving position and a second terminated position wherein the conductor engaging portions 154 extend into passageway 140 so as to enter the channels 118 of carrier 112. In the preferred embodiment, all terminals 150 are simultaneously terminated to their respective conductors 114 in a single mass termination operation. However, other termination operations are also possible. Although not specifically shown in the figures, it should be understood that the connector arrangement of FIGS. 5–8 can readily accommodate an external metallic shield substantially identical in its features and functions to that of FIG. 3b described above. The shield would extend over carrier portions 120, 126, between terminals 150. The forward portions of the cable shield adjacent mating face 122 of carrier 112, can function as terminal-emulating members readily terminated in a receptacle connector.

Figure 9:
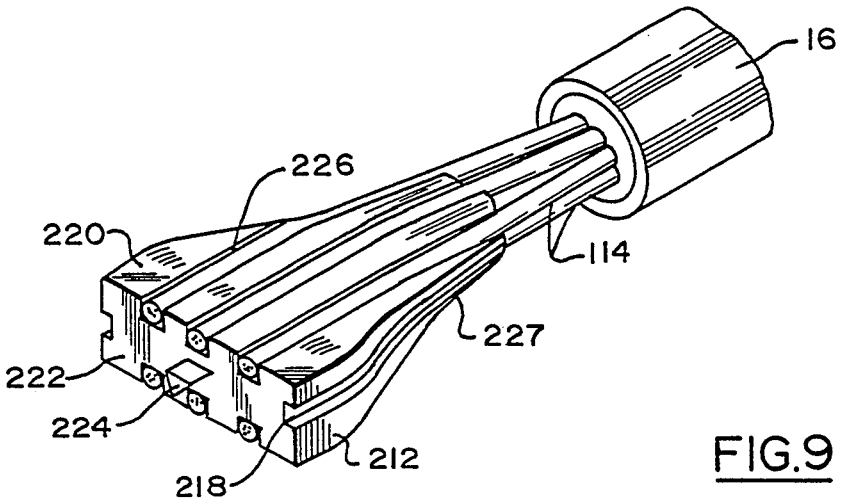
FIG. 9 is a perspective view of an alternative wire carrier of the present invention.

Referring now to FIG. 9, another alternative embodiment of a wire carrier designated by the numeral 212. Carrier 212 is similar in function and features through the carriers 12 and 112 described above. The principal difference is that carrier 212 has a forward rectangular surface 220, as in FIGS. 5–8, and a rearward cylindrical or conical surface 227, as in FIGS. 1–4. A transition surface 226 is provided between surfaces 220, 227 and continuous wire-receiving recesses or channels 218 extend along surface 220, 226, and 227.

Carrier 212 has a forward mating face 222 from which a polarizing projection 224 extends.

Although not shown in the drawing, it should be understood that the housing which receives carrier 212 has an internal wire and carrier-receiving channel of complementary configuration, a feature common to all embodiments of the present invention. As such, strain relief for the individual conductors 14 of round cable 16 can be provided on surfaces 226 and/or 220, as well as surface 227. As such, the transition surface 226 can have top and bottom walls generally parallel to each other, or which converge in a direction away from mating face 222. If the later converging arrangement is provided for intermediate surfaces 226, a wedging strain relief provision can also be obtained the center portion of carrier 212. In a similar manner, the rearward surface 227 can either by cylindrical or conical and if conical to provide strain relief, its taper would extend in a direction away from mating surface 222.

Termination to the wires 14 carried by member 212 can be effected in a manner similar to that described above. That is, insulation piercing terminals can be applied to portions of conductors 14 lying in the channel portions formed in the forward carrier part 220. With the description given above with respect to the first embodiment of FIGS. 1–4 and the second embodiment of FIGS. 5–8, one skilled in the art can readily construct a housing mateable with carrier 212, without further invention or experimentation.

In each embodiment of the present invention, a connector manufacturer can provide to the end user, a two-piece plug connector assembly, readily adaptable for mass termination automated assembly. The terminals of each embodiment would be preloaded in the connector housing in precise alignment with the internal housing passageway. The carrier which receives the conductors of a given cable can be polarized or keyed to provide precise alignment with the terminals carried in the housing providing easy, full-proof assembly. The insertion of the carrier within the housing automatically provides strain relief for the individual circuit conductors and prepares the connector assembly for a mass termination operation.

I claim:

1. A connector for terminating a plurality of insulated conductors, comprising:

a housing having a front mating end with an opening therein and a rear cable receiving end with an opening therein, and an internal passageway extending between said openings;

a plurality of terminals mounted in said housing around the periphery thereof, each having an internally extending conductor engaging portion and an external mating contact portion, said terminals moveable between a first carrier-receiving position and a second terminated position wherein said conductor engaging portions extend into the passageway;

a conductor carrier telescopically received in said passageway, said carrier having an external conductor-receiving surface adjacent said terminals, tapered toward the rear end, and having means for receiving and aligning said conductors with the conductor engaging portions of respective terminals; and said passageway having a configuration complementary to said carrier with said front opening being larger than said rear opening;

whereby said carrier is receivable into the passageway through the front opening of the housing after said wires have been received on the surface thereof, and said conductors are terminated to said terminals when said terminals are moved to their terminated positions.

2. The connector of claim 1 wherein said carrier and said passageway are dimensioned so that, when said carrier is inserted in said housing, said wires are pressed against said rear housing end by said carrier to provide strain relief therefor.

3. The connector of claim 2 wherein said carrier has a front end opposite said rear end, with keying means at the front end providing predetermined rotational alignment of said plug connector with a mating receptacle connector.

4. The connector of claim 1 wherein said carrier has a cone-like configuration for mounting a plurality of radially-extending terminals.

5. The connector of claim 4 wherein said keying means is aligned with the axis of said cone-like carrier.

6. The connector of claim 5 wherein said keying means comprises a protrusion extending from the larger ends of said cone.

7. The connector of claim 5 wherein said keying means comprises a recess extending into said carrier from the larger end thereof.

8. A method of assembling a connector for terminating a plurality of insulated conductors, the connector including a housing having a front mating end with an opening therein and a rear cable receiving end with an opening therein, and an internal passageway extending between said openings, a plurality of terminals mounted in said housing around the periphery thereof, each having an internally extending conductor engaging portion and an external mating contact portion, said terminals moveable between a first carrier-receiving position and a second terminated position wherein said conductor engaging portions extend into the passageway, and a conductor carrier telescopically received in said passageway, said carrier having an external conductor-receiving surface adjacent said terminals and tapered toward the rear end, with means for receiving and aligning said conductors with the conductor engaging portions of respective terminals, and said passageway having a configuration complementary to said carrier with said front opening being larger than said rear opening, comprising the steps of:

inserting free ends of said conductors cable through said second housing end so that said conductor free ends extend beyond said first mating housing end;

engaging said conductors with said external carrier surface;

inserting said carrier and said conductors into said housing mating ends while maintaining engagement between said carrier and said conductors; and moving said terminals toward said carrier to their second terminated positions, to terminate respective wires.

9. The method of claim 8 wherein said step of inserting said carrier in said passageway including the step of pressing said conductors against said rear housing end with said carrier, thereby relieving strain on said conductors.

* * * * *